US011670224B1

(12) United States Patent
Cheng et al.

(10) Patent No.: US 11,670,224 B1
(45) Date of Patent: Jun. 6, 2023

(54) DRIVING CIRCUIT FOR LED PANEL AND LED PANEL THEREOF

(71) Applicant: NOVATEK Microelectronics Corp., Hsin-Chu (TW)

(72) Inventors: Jhih-Siou Cheng, New Taipei (TW); Chun-Fu Lin, Taoyuan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/570,317

(22) Filed: Jan. 6, 2022

(51) Int. Cl.
*G09G 3/32* (2016.01)

(52) U.S. Cl.
CPC ..... *G09G 3/32* (2013.01); *G09G 2300/0452* (2013.01); *G09G 2300/06* (2013.01); *G09G 2310/0202* (2013.01); *G09G 2310/0267* (2013.01); *G09G 2330/021* (2013.01)

(58) Field of Classification Search
CPC ..... G09G 3/32; G09G 2300/0452; G09G 2300/06; G09G 2310/0202; G09G 2310/0267; G09G 2330/021
See application file for complete search history.

(56) References Cited

U.S. PATENT DOCUMENTS 5,751,263 A * 5/1998 Huang ..... G09G 3/3266 345/82
6,985,124 B1 * 1/2006 Nogawa ..... G09G 3/32 345/82
7,450,094 B2 * 11/2008 Kim ..... G09G 3/3216 345/78
8,373,346 B2 * 2/2013 Hoogzaad ..... H05B 45/375 315/193
9,035,935 B2 * 5/2015 Kawano ..... G09G 5/001 345/212
9,443,478 B2 * 9/2016 Min ..... G09G 3/3413
10,127,858 B1 * 11/2018 Zhou ..... G09G 3/3216
10,172,194 B2 * 1/2019 Furukawa ..... H05B 45/60
10,636,357 B1 * 4/2020 Brownlow ..... G09G 3/32
11,397,351 B2 * 7/2022 Inoue ..... G09G 3/32
11,462,154 B1 * 10/2022 Chang ..... G09G 3/3216
2003/0112207 A1 * 6/2003 Kim ..... G09G 3/3216 345/82
2007/0095639 A1 * 5/2007 Kim ..... G09G 3/3216 200/310
2007/0252789 A1 * 11/2007 Kim ..... G09G 3/3216 345/76
2008/0068298 A1 * 3/2008 Shen ..... G09G 3/14 345/46
2008/0186258 A1 * 8/2008 Ishimoto ..... G09G 3/3216 345/76
2009/0153078 A1 * 6/2009 Lin ..... H05B 45/00 315/312
2011/0062889 A1 * 3/2011 Hoogzaad ..... G09G 3/342 315/294

(Continued)

*Primary Examiner* — Michael J Jansen, II
(74) *Attorney, Agent, or Firm* — Winston Hsu

(57) ABSTRACT

A driving circuit for a light-emitting diode (LED) panel includes a first current source and a second current source. The first current source, coupled to a current source terminal of the driving circuit, is configured to output a first current to the LED panel through the current source terminal. The second current source, coupled to a current sink terminal of the driving circuit, is configured to receive a second current from the LED panel through the current sink terminal.

10 Claims, 12 Drawing Sheets

(56) References Cited

U.S. PATENT DOCUMENTS

| | | | | |
|---|---|---|---|---|
| 2011/0298384 | A1* | 12/2011 | Tanigawa | G09G 3/3406 315/209 R |
| 2012/0112642 | A1* | 5/2012 | Ikeda | G09G 3/3233 315/161 |
| 2012/0188293 | A1* | 7/2012 | Furukawa | H05B 45/382 315/210 |
| 2012/0242236 | A1* | 9/2012 | Vaananen | G09G 3/3413 315/192 |
| 2013/0038819 | A1* | 2/2013 | Ishikawa | H05B 45/46 315/161 |
| 2013/0049614 | A1* | 2/2013 | Kang | H05B 45/395 315/186 |
| 2013/0278586 | A1* | 10/2013 | Kawano | G09G 5/001 345/212 |
| 2014/0375930 | A1* | 12/2014 | Zhang | H05B 45/38 315/186 |
| 2016/0042699 | A1* | 2/2016 | Min | G09G 3/3413 345/82 |
| 2016/0163773 | A1* | 6/2016 | Hochman | G09G 3/3225 438/35 |
| 2017/0069270 | A1* | 3/2017 | Hyeon | G09G 3/3216 |
| 2018/0130405 | A1* | 5/2018 | Lee | G09G 3/2022 |
| 2020/0312226 | A1* | 10/2020 | Hussell | G09G 3/3413 |
| 2020/0320925 | A1* | 10/2020 | Luo | G09G 3/32 |
| 2021/0074219 | A1* | 3/2021 | Hung | G09G 3/3266 |
| 2022/0043302 | A1* | 2/2022 | Inoue | G09G 3/3216 |
| 2022/0293041 | A1* | 9/2022 | Chang | G09G 3/32 |

* cited by examiner

DRIVING CIRCUIT FOR LED PANEL AND LED PANEL THEREOF

BACKGROUND OF THE INVENTION

1. Field of the Invention

The present invention relates to a driving circuit for a display panel and the related display panel, and more particularly, to a driving circuit for a light-emitting diode (LED) panel and the related LED panel.

2. Description of the Prior Art

Light-emitting diodes (LEDs) are widely used in various display devices such as television screens, computer monitors, outdoor displays, and portable systems such as mobile phones and handheld game consoles . Display of an LED panel is usually controlled and driven by a driving circuit, which may output data signals and scan signals to control the LED pixels to emit light.

For example, for a passive matrix LED (PM-LED) panel, the driving circuit is configured with constant current sources for outputting currents to drive the LEDs on the panel. Please refer to FIG. 1, which is a schematic diagram of the driving architecture of a PM-LED panel, which includes a constant current source 100 connected to a plurality of LEDs (LED1-LED4) , and each LED LED1-LED4 is connected to a select switch SW1-SW4, respectively. Under control of the select switches SW1-SW4, each LED LED1-LED4 may be driven based on time division.

FIG. 1 illustrates a constant current source that may be coupled to a column of LEDs, among which each LED is further coupled to a select switch. Each select switch may be coupled to a row of LEDs, as the architecture shown in FIG. 2. FIG. 2 illustrates a select switch SW coupled to an LED array on the panel. More specifically, the select switch SW may be coupled to M LED pixels, where each LED pixel includes a green LED LED_G, a blue LED LED_B, and a red LED LED_R, which are driven by constant current sources C_G, C_B and C_R, respectively. The constant current sources C_G, C_B and C_R provide constant output currents by receiving a power supply voltage VLED.

In order to reduce the power consumption of the overall LED driving system, the power supply voltage VLED is requested to be as small as possible. However, the power supply voltage VLED should be greater than a level to make the LED panel operate normally. As shown in FIG. 2, the power supply voltage VLED is equal to:

$$VLED=Vds+Vf+I_{SW}\times R_{SW};$$

where Vds is the drain-to-source voltage of the transistors used to realize the constant current sources C_G, C_B and C_R, Vf is the turned-on voltage of each LED LED_G, LED_B and LED_R, $I_{SW}$ is the current flowing through the select switch SW, and $R_{SW}$ is the turned-on resistance of the select switch SW. In general, the value of the drain-to-source voltage Vds should be large enough to provide enough headroom that allows the transistors of the constant current sources C_G, C_B and C_R to provide constant currents. In other words, in order to output constant currents, these transistors should be operated in the saturation region and prevented from entering the linear region, so that the drain-to-source voltage Vds is requested to be greater than a specific level.

However, with the trends of large scale and high resolution of the display panels, the number of LED pixels coupled to a select switch SW may be increased (i.e., M is increased), which increases the current $I_{SW}$ passing through the select switch SW, and thereby increases the voltage value required for the power supply voltage VLED. Since the system power consumption is proportional to the magnitude of the power supply voltage VLED, the increasing power supply voltage VLED will result in increasing power consumption, especially for a large-scale panel application.

For example, a large-scale LED panel is usually applied to an outdoor display device such as a public information display (PID) or digital signage. Since the outdoor display device may continuously deliver videos without intermission every day, the power consumption will become an important issue to be considered for the LED panel products. Thus, there is a need for providing a novel structure of an LED panel which can be driven with less power consumption.

SUMMARY OF THE INVENTION

It is therefore an objective of the present invention to provide the structures of a driving circuit for a light-emitting diode (LED) panel and the related LED panel, in order to solve the abovementioned problems.

An embodiment of the present invention discloses a driving circuit for an LED panel, which comprises a first current source and a second current source. The first current source, coupled to a current source terminal of the driving circuit, is configured to output a first current to the LED panel through the current source terminal. The second current source, coupled to a current sink terminal of the driving circuit, is configured to receive a second current from the LED panel through the current sink terminal.

Another embodiment of the present invention discloses an LED panel, which comprises a first LED and a second LED. An anode of the first LED is coupled to a first signal line, and a cathode of the first LED is coupled to a scan line. An anode of the second LED is coupled to the scan line, and a cathode of the second LED is coupled to a second signal line.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
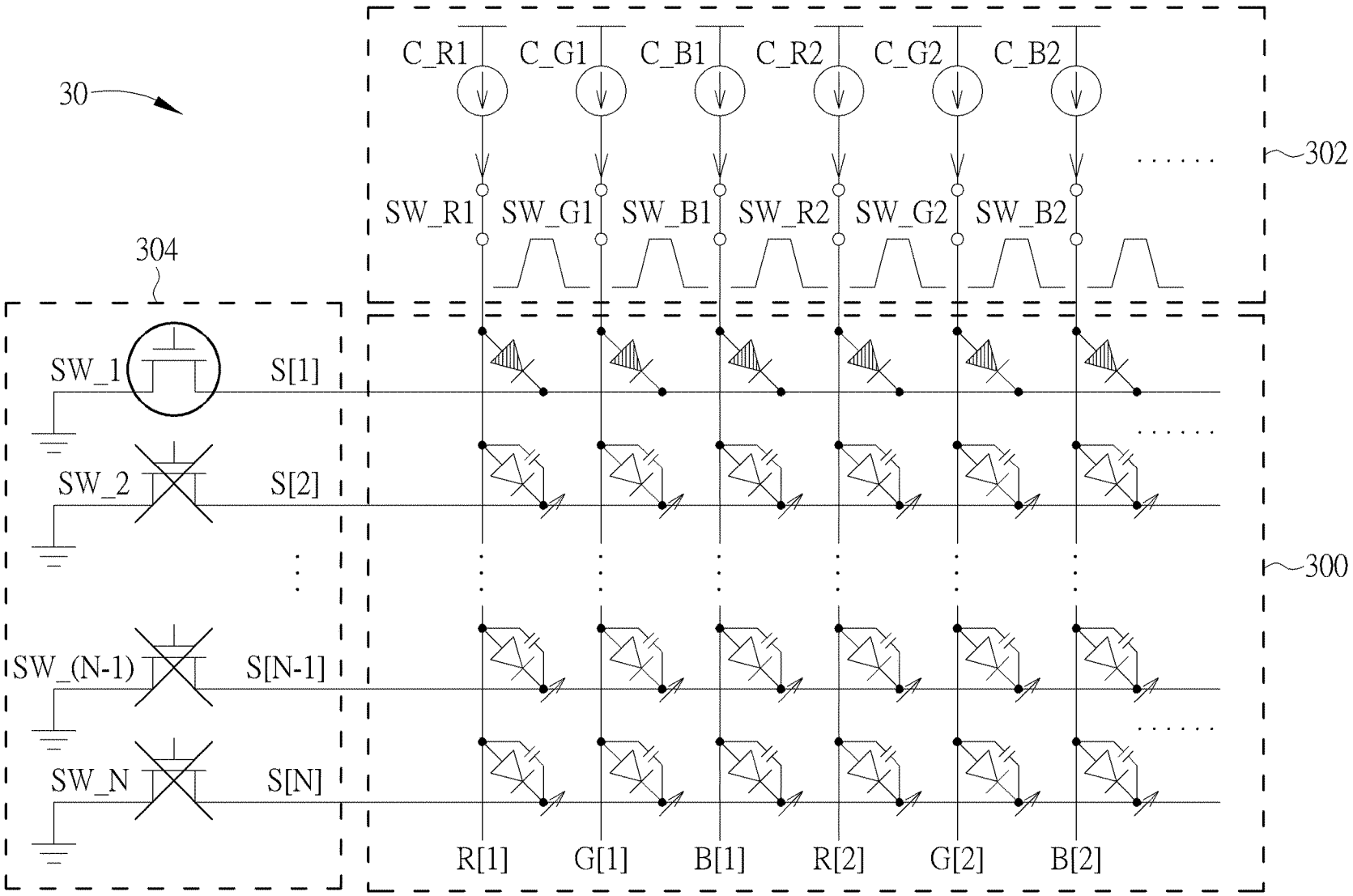
FIGS. 3 and 4 are schematic diagrams of general display systems.

Please refer to FIG. 3, which is a schematic diagram of a general display system 30. As shown in FIG. 3, the display system 30 includes a display panel 300, a data driver 302 and a scan driver 304. The display panel 300 includes a light-emitting diode (LED) array, where each LED is coupled to one of the signal lines R[1], G[1], B[1], R[2], G[2], B[2], . . . and one of the scan lines S[1]-S[N]. The signal lines R[1], G[1], B[1], R[2], G[2] and B[2] are respectively coupled to current sources C_R1, C_G1, C_B1, C_R2, C_G2 and C_B2 in the data driver 302. The scan lines S[1]-S[N] are respectively coupled to select switches SW_1-SW_N in the scan driver 304.

The data driver 302 is configured to output display data signals to the LEDs on the display panel 300. In this example, the current sources C_R1, C_G1, C_B1, C_R2, C_G2 and C_B2 in the data driver 302 are used for outputting driving currents to drive the LEDs on the display panel 300. The LEDs may emit light when receiving the driving currents. The current sources C_R1, C_G1, C_B1, C_R2, C_G2 and C_B2 may be coupled to and controlled by control switches SW_R1, SW_G1, SW_B1, SW_R2, SW_G2 and SW_B2, respectively. In each display cycle, each control switch may be selectively turned on or off, to determine whether the current sources need to output currents to light on the selected LEDs in this display cycle. The length of the turned-on pulse of the control switches may be used to determine the brightness of the selected LEDs. The LEDs maybe scanned and selected line by line. As shown in FIG. 3, a row of LEDs are coupled to one of the scan lines S[1]-S[N], where the corresponding select switches SW_1-SW_N are turned on in sequence, so as to scan the LEDs line by line. Based on the controls of the data driver 302 and the scan driver 304, each LED on the display panel 300 may show desired brightness, in order to construct a desired image in each frame.

FIG. 3 shows that the first row of LEDs are scanned, where the select switch SW_1 is turned on and other select switches SW_2-SW_N are turned off. In such a situation, the currents output by the current sources C_R1, C_G1, C_B1, C_R2, C_G2 and C_B2 will flow through the LEDs in the first row, to drive these LEDs to emit light. In this example, each pixel may be composed of a red LED, a green LED and a blue LED, but those skilled in the art should understand that the implementation of the LED pixels is not limited thereto.

Please note that the implementation of the LED pixels as shown in FIG. 3 is a common-cathode structure, where the cathode of a row of LEDs is commonly coupled to a scan line. In another example, the LED pixels may be connected as a common-anode structure, where the anode of a row of LEDs is commonly coupled to a scan line, as shown in FIG. 4.

Figure 4:
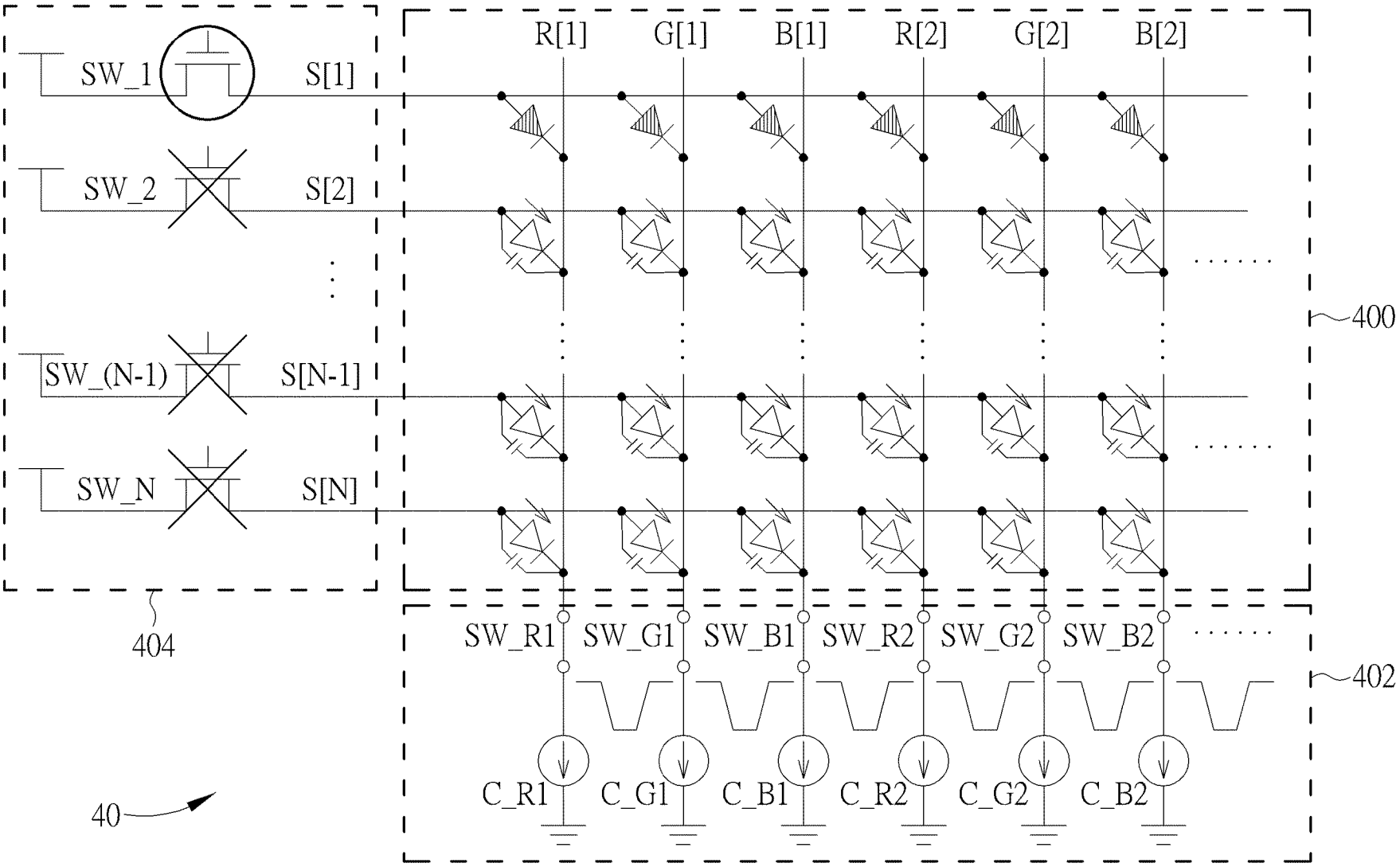

More specifically, FIG. 4 illustrates another display system 40 including a display panel 400, a data driver 402 and a scan driver 404. The display panel 400 includes an LED array where the LEDs are connected in a common-anode manner. In detail, the cathode of each LED is coupled to a signal line, and the anode of each LED is coupled to a scan line. The corresponding select switches SW_1-SW_N in the scan driver 404 are turned on in sequence, so as to scan the LEDs line by line. The current sources C_R1, C_G1, C_B1, C_R2, C_G2 and C_B2 in the data driver 402 aim at providing sink currents for the turned-on LEDs in each display cycle, where the brightness of the LEDs is determined based on the turned-on pulses of the control switches SW_R1, SW_G1, SW_B1, SW_R2, SW_G2 and SW_B2 in the data driver 402.

As mentioned above, with the increasing number of LEDs on the display panel, each select switch is responsible for controlling more LEDs, and more currents may flow through the select switch. This increases the power supply voltage received by the current sources in the data driver, thereby increasing the overall power consumption of the display system. In order to solve the problem, the present invention provides a hybrid structure for the LED panel where the common-cathode structure and the common-anode structure coexist. For example, a scan line may be coupled to the cathode of several LEDs and the anode of several LEDs. As a result, the source currents and the sink currents may cancel out each other, so that the current passing through a select switch may be equal to the difference between the source currents and the sink currents, which may be far smaller than the current passing through the select switch with the panel structure as shown in FIG. 3 or 4. This reduces the voltages required by the current sources and thereby reduces the power consumption of the display system.

Figure 5:
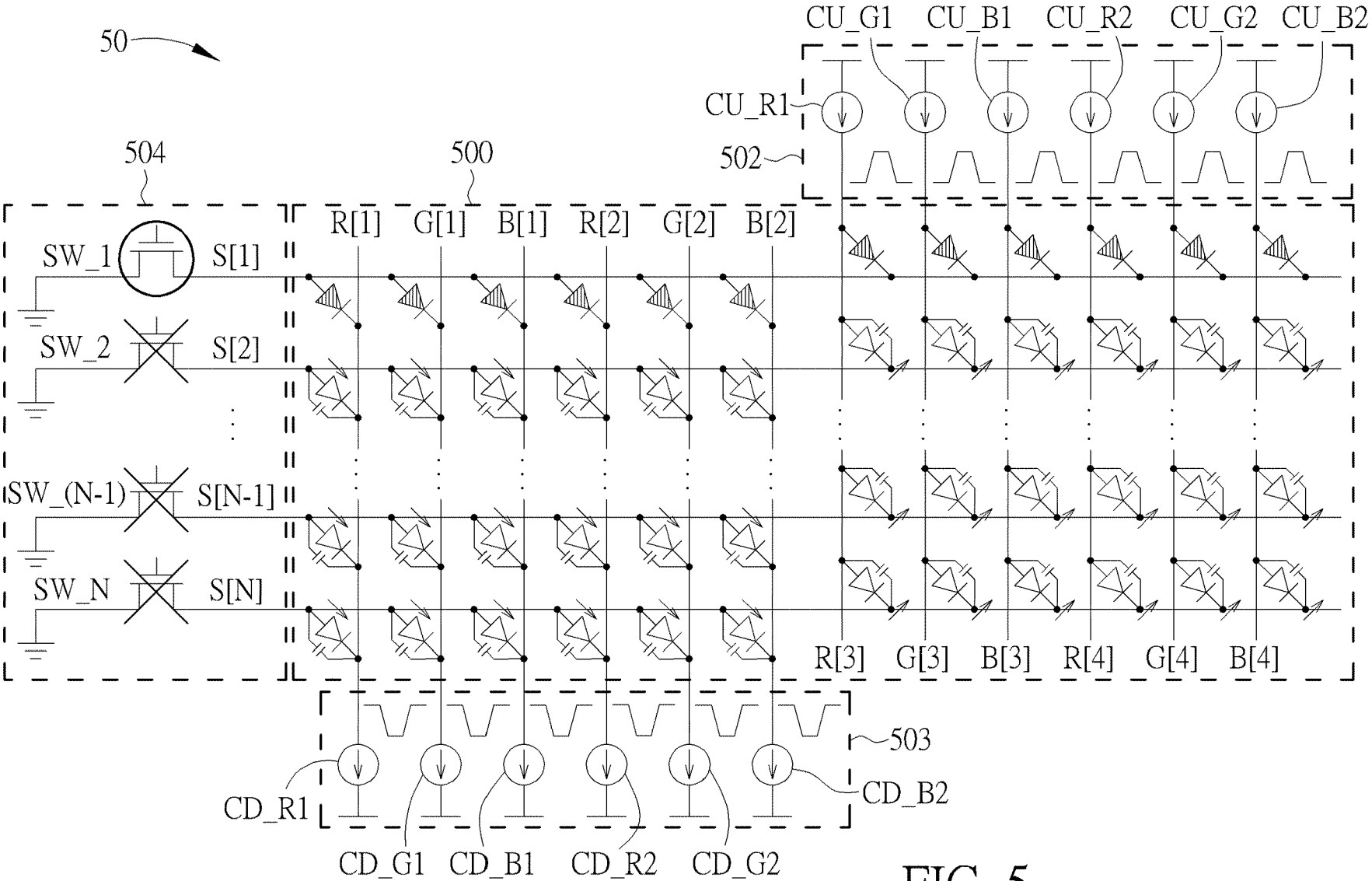
FIG. 5 is a schematic diagram of a display system according to an embodiment of the present invention.

Please refer to FIG. 5, which is a schematic diagram of a display system 50 according to an embodiment of the present invention. As shown in FIG. 5, the display system 50 includes a display panel 500, data drivers 502 and 503, and a scan driver 504. In the display panel 500, the LEDs coupled to the signal lines R[1], G[1], B[1], R[2], G[2] and B[2] are connected in the common-anode manner, where the anode of each LED is connected to the corresponding scan line and the cathode of each LED is connected to the corresponding signal line. The LEDs coupled to the signal lines R[3], G[3], B[3], R[4], G[4] and B [4 ] are connected in the common-cathode manner, where the cathode of each LED is connected to the corresponding scan line and the anode of each LED is connected to the corresponding signal line.

As for those LEDs with the common-cathode connections, light emission is performed by receiving source currents from the data driver 502 through one of the signal lines R[3], G[3], B[3], R[4], G[4] and B[4]. As for those LEDs with the common-anode connections, light emission is performed by outputting sink currents to the data driver 503 through one of the signal lines R[1], G[1], B[1], R[2], G[2] and B[2].

The data drivers 502 and 503 include current sources for providing source currents and sink currents, respectively, for driving the LEDs on the display panel 500. In detail, the data driver 502 includes current sources CU_R1, CU_G1, CU_B1, CU_R2, CU_G2 and CU_B2, which are coupled to the display panel 500 through current source terminals, to output driving currents to the LEDs on the display panel 500 through the current source terminals, respectively. Under the common-cathode structure of the LED pixels, the current sources CU_R1, CU_G1, CU_B1, CU_R2, CU_G2 and CU_B2 are coupled to the anode of the LEDs, and the driving currents are output to the anode of the LEDs. The data driver 503 includes current sources CD_R1, CD_G1, CD_B1, CD_R2, CD_G2 and CD_B2, which are coupled to the display panel 500 through current sink terminals, to receive sink currents from the LEDs on the display panel 500 through the current sink terminals, respectively. Under the common-anode structure of the LED pixels, the current sources CD_R1, CD_G1, CD_B1, CD_R2, CD_G2 and CD_B2 are coupled to the cathode of the LEDs, and the sink currents are received from the cathode of the LEDs. The data drivers 502 and 503 may further include control switches to be coupled to the current sources. The implementations and operations of the control switches are similar to those shown in FIGS. 3 and 4, and will be omitted herein for brevity.

The operations of the scan driver 504 and the select switches SW_1-SW_N are similar to those described above;

that is, the select switches SW_1-SW_N are turned on in sequence to scan the LEDs on the display panel 500 line by line.

In the display panel 500 as shown in FIG. 5, the anode of those LEDs with the common-anode structure and the cathode of those LEDs with the common-cathode structure are commonly coupled to the scan lines S[1]-S[N] and the select switches SW_1-SW_N. More specifically, the anode of the common-anode LEDs and the cathode of the common-cathode LEDs in the same row are coupled to the same select switch and driven by the same scan signal. Therefore, the source currents flowing through several LEDs may be flowed to other LEDs as the sink currents, thereby significantly reducing the current passing through the select switches SW_1-SW_N in the scan driver 504. The magnitude of the power supply voltage used for the current sources and the overall power consumption of the display system 50 are therefore reduced.

Figure 6:
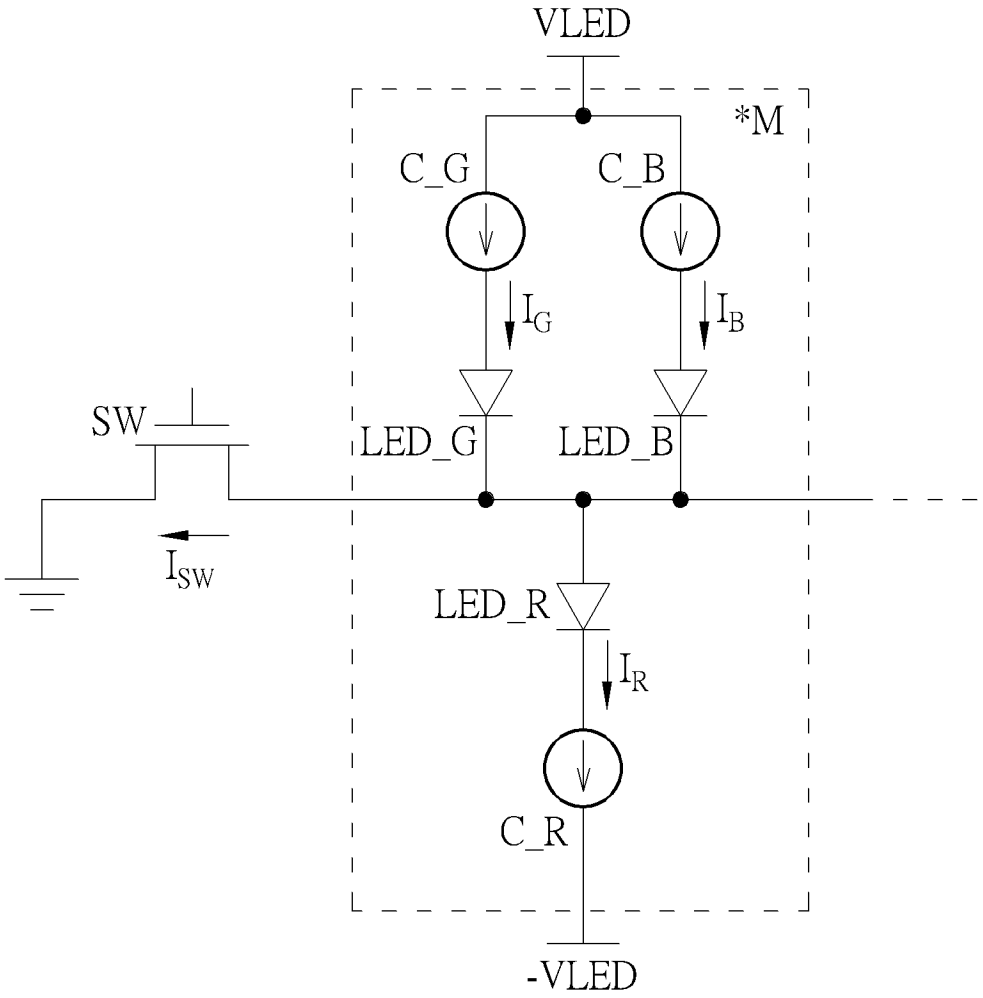
FIGS. 6-9 are schematic diagrams of exemplary pixel structures according to embodiments of the present invention.

The common-cathode and common-anode structures maybe deployed in any appropriate manner. Please refer to FIG. 6, which is a schematic diagram of an exemplary pixel structure according to an embodiment of the present invention. As shown in FIG. 6, the pixel may be an LED pixel on an LED panel such as the display panel 500 shown in FIG. 5. The LED pixel includes a red LED LED_R, a green LED LED_G and a blue LED LED_B, which are coupled to and driven by current sources C_R, C_G and C_B in the data driver through corresponding signal lines, respectively. The current sources C_R, C_G and C_B may output constant currents by receiving a positive power supply voltage VLED or a negative power supply voltage −VLED. When the LEDs LED_R, LED_G and LED_B are configured to emit light, the current sources C_R, C_G and C_B may provide driving currents $I_R$, $I_G$ and $I_B$ for the LEDs LED_R, LED_G and LED_B, respectively. The LEDs LED_R, LED_G and LED_B are commonly coupled to a select switch SW in the scan driver through the same scan line. In this embodiment, the select switch SW and the scan line are connected to the anode of the red LED LED_R, the cathode of the green LED LED_G, and the cathode of the blue LED_B.

As shown in FIG. 6, the LED panel may include M pixels in the same row, which are coupled to the same select switch SW, where each pixel has the same structure. Supposing that every LED in this row is lit on as being driven by the corresponding current in a display cycle, the current $I_{SW}$ flowing through the select switch SW may be equal to $(I_G+I_B-I_R)\times M$. Note that the luminance efficiency of the green LEDs and the blue LEDs is usually greater than the luminance efficiency of the red LEDs; hence, the red LEDs usually require more currents to achieve the same brightness as the green and blue LEDs. In such a situation, the summation of the driving current $I_G$ for the green LED LED_G and the driving current $I_B$ for the blue LED LED_B minus the driving current $I_R$ for the red LED LED_R may reach an extremely low value, which allows the select switch SW to pass through a small current and thus have a low crossing voltage.

Figure 1:
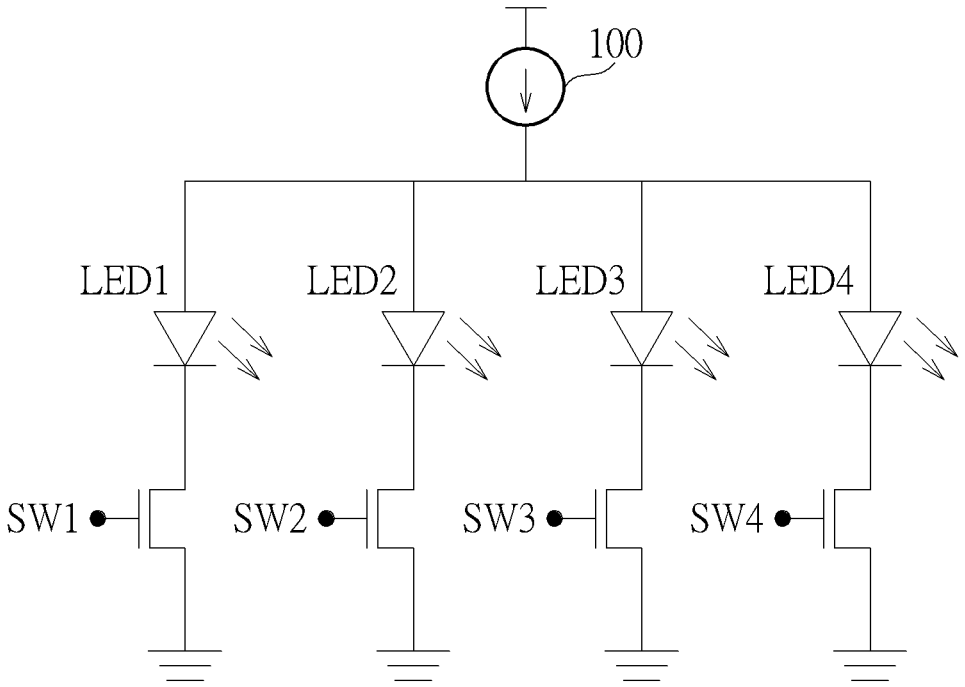
FIG. 1 PRIOR ART
FIG. 1 is a schematic diagram of the driving architecture of a PM-LED panel.
Figure 2:
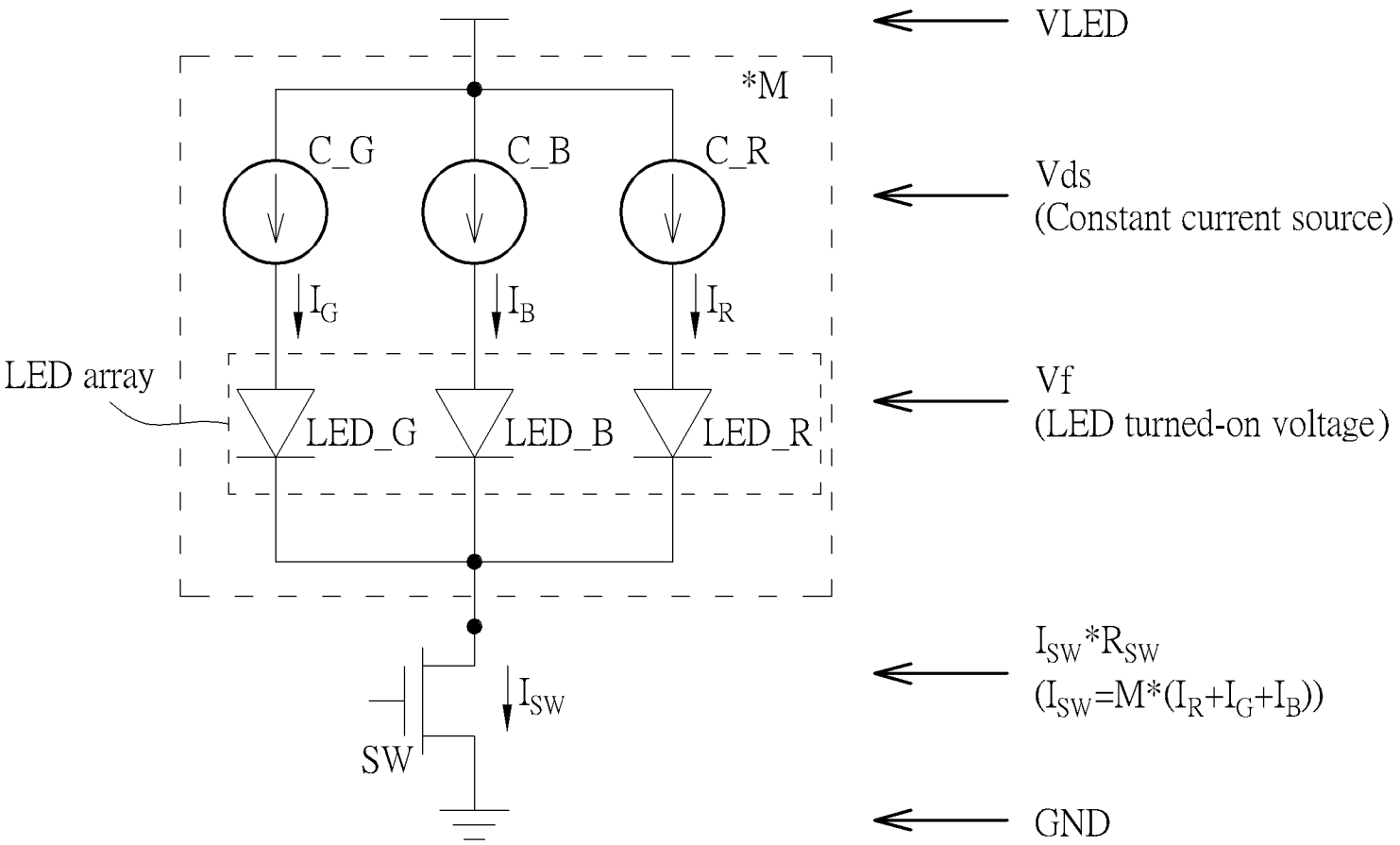
FIG. 2 PRIOR ART
FIG. 2 illustrates the architecture of a select switch coupled to an LED array on the panel.

Please refer to FIG. 6 and FIG. 2 for comparison. In the pixel structure as shown in FIG. 2, the LEDs LED_R, LED_G and LED_B are connected in a common-cathode manner; that is, the cathode of each of the LEDs LED_R, LED_G and LED_B is commonly coupled to the select switch SW. In such a situation, when all LEDs coupled to the select switch SW are turned on, the current $I_{SW}$ flowing through the select switch SW may be equal to $(I_R+I_G+I_B)\times M$. With the increasing number of LED pixels coupled to the select switch SW (i.e., increasing M), the current $I_{SW}$ may increase proportionally, which increases the requirement of the magnitude of the power supply voltage VLED and also increases the power consumption. In comparison, according to the present invention, the LED pixels may be connected as the structure shown in FIG. 6; that is, the cathode of the green LED LED_G, the cathode of the blue LED LED_B, and the anode of the red LED LED_R are commonly coupled to the select switch SW. When all LEDs coupled to the select switch SW are turned on, the current $I_{SW}$ flowing through the select switch SW may be equal to $(I_G+I_B-I_R)\times M$. In such a situation, the current $I_{SW}$ flowing through the select switch SW is significantly reduced, which thereby reduces the crossing voltage of the select switch SW. As a result, the requirement of the magnitudes of the power supply voltages VLED and −VLED may be reduced, which in turn reduces the power consumption of the display system.

Please note that the pixel structure shown in FIG. 6 is one of various implementations of the present invention. Based on the combination of the common-cathode and common-anode implementations, there are many possible pixel structures capable of reducing the current $I_{SW}$ of the select switch SW. Several examples are shown in FIGS. 7, 8 and 9.

Figure 7:
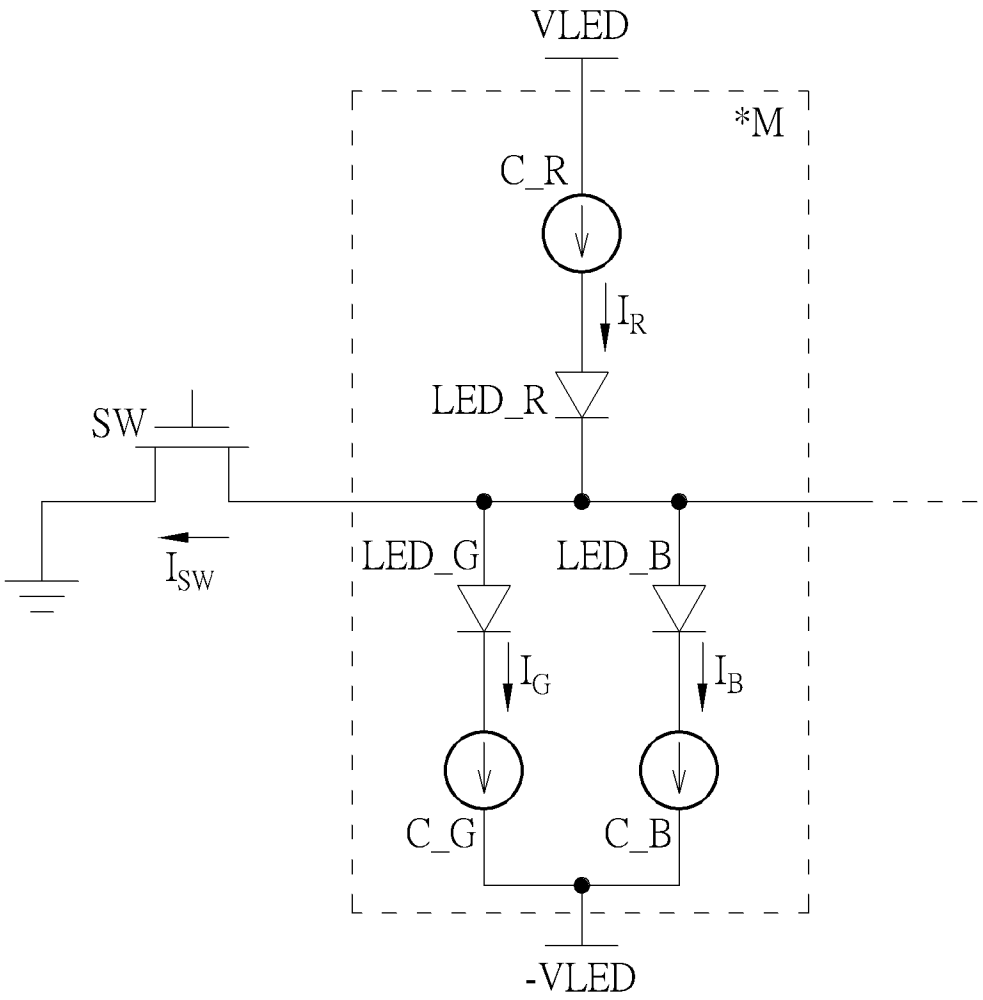

More specifically, FIG. 7 shows a pixel structure where the cathode of the red LED LED_R, the anode of the green LED LED_G, and the anode of the blue LED LED_B in a pixel are commonly coupled to the scan line and the select switch SW. Supposing that the select switch SW is coupled to M pixels, the current $I_{SW}$ flowing through the select switch SW is equal to $(I_R-I_G-I_B)\times M$, which may be a quite small value since the LED currents of different colors cancel out each other.

Figure 8:
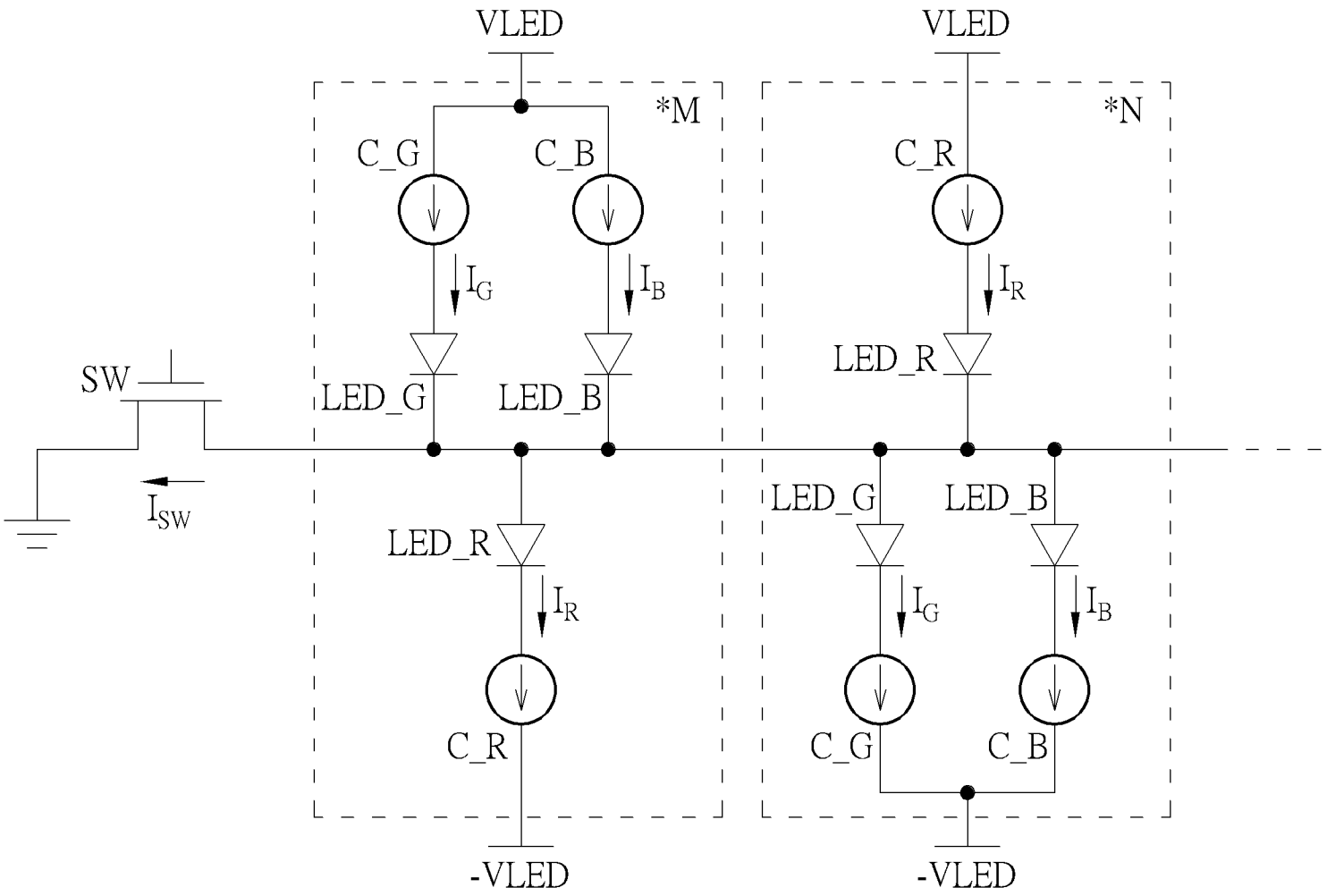

FIG. 8 shows a pixel structure where M pixels are implemented with the structure as shown in FIG. 6 and N pixels are implemented with the structure as shown in FIG. 7. In this implementation, the current $I_{SW}$ flowing through the select switch SW will be approximately equal to 0 if M and N are substantially equal.

Figure 9:
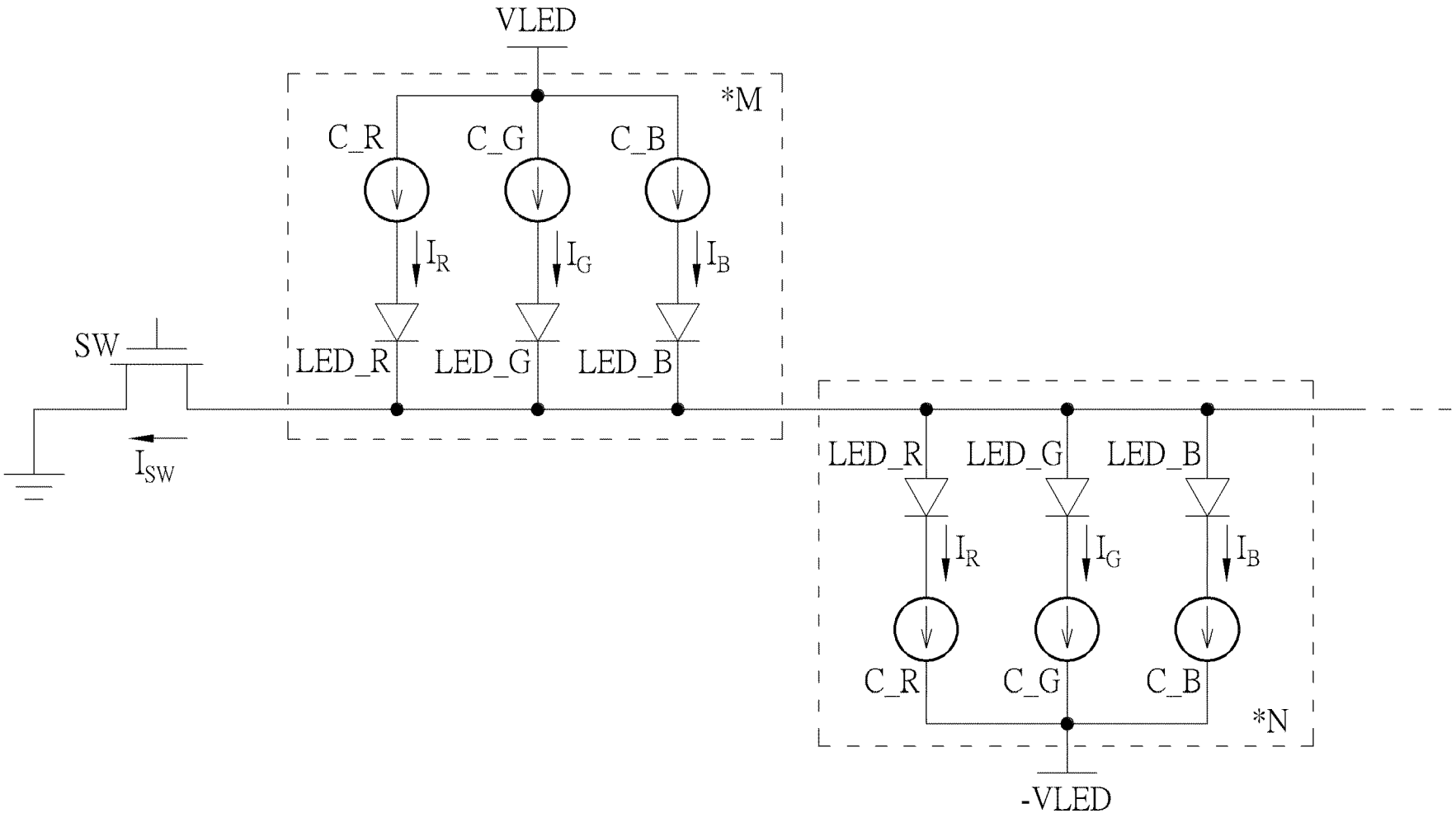

FIG. 9 shows another pixel structure where M pixels have the common-cathode structure and N pixels have the common-anode structure. In this implementation, the current $I_{SW}$ flowing through the select switch SW will also be approximately equal to 0 if M and N are substantially equal.

In addition to reducing the power consumption of the display system, the pixel structure of the present invention may also achieve the benefit of improving the picture quality. In general, in an LED panel having an LED array controlled through signal lines and scan lines, each LED may include a parasitic capacitor coupled between the corresponding signal line and the corresponding scan line. The parasitic capacitor may couple the driving signals on the signal line to the floating scan lines, and the variations on these floating scan lines are further coupled back to the signal lines to influence the signal transients.

Please refer back to FIGS. 3 and 4. As shown in FIG. 3, when the select switch SW_1 is turned on to scan the first row of LEDs, other select switches SW_2-SW_N are turned off to let other scan lines S[2]-S[N] to be floating. In such a situation, the rising pulses on the signal lines may raise the voltage of these floating scan lines S[2]-S[N] through the coupling of parasitic capacitors. Since a row of LEDs are commonly coupled to one scan line, the pulse signals on all the signal lines may provide coupling effects to raise the voltage of the floating scan lines S[2]-S[N]. The rising voltage of the floating scan lines S[2]-S[N] maybe coupled back to the signal lines, to increase the transient speed of the pulses, which may influence the pulse width and change the brightness of the LEDs. Similarly, as shown in FIG. 4, when the select switch SW_1 is turned on to scan the first row of LEDs, other select switches SW_2-SW_N are turned off to let other scan lines S[2]-S[N] to be floating. In such a situation, the falling pulses on the signal lines may lower the voltage of these floating scan lines S[2]-S[N] through the coupling of parasitic capacitors. Since a row of LEDs are commonly coupled to one scan line, the pulse signals on all the signal lines may provide coupling effects to lower the voltage of the floating scan lines S[2]-S[N]. The falling voltage of the floating scan lines S[2]-S[N] may be coupled back to the signal lines, to increase the transient speed of the pulses, which may influence the pulse width and change the brightness of the LEDs. With the trends of large scale and high resolution of the display panels, the number of LED pixels coupled to each scan line may be increased, which thereby increases the influences of the coupling capacitors, causing evident inconsistency on the displayed images.

Figure 10:
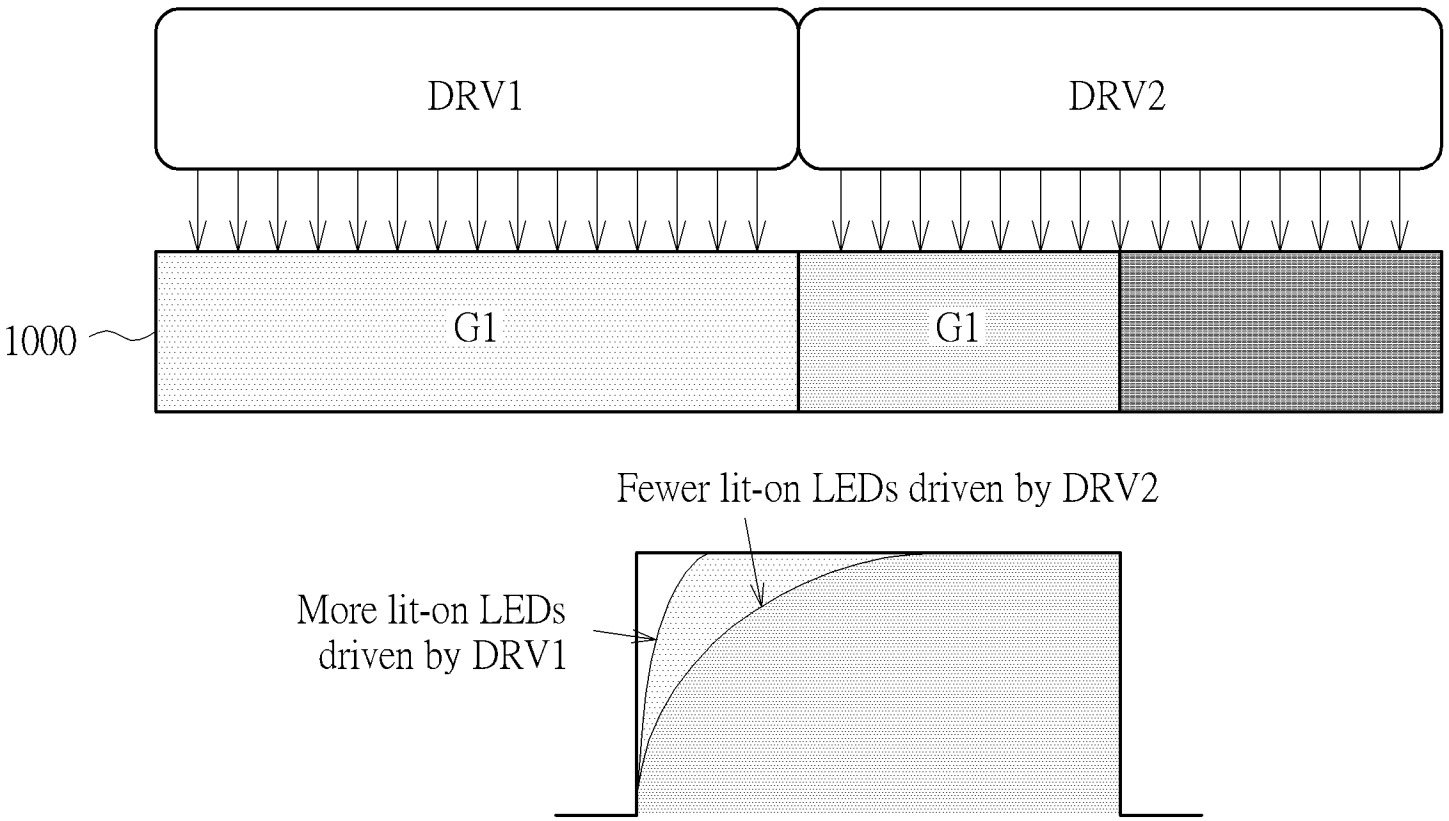
FIG. 10 is a schematic diagram of a display panel in which the displayed image is influenced by the coupling capacitors.

For example, please refer to FIG. 10, which is a schematic diagram of a display panel 1000 in which the displayed image is influenced by the coupling capacitors . As shown in FIG. 10, the display panel 1000 may include two parts, where a first part (e.g., the left-half part) is controlled by a driving circuit DRV1 and a second part (e.g., the right-half part) is controlled by another driving circuit DRV2. In an embodiment, the display panel 1000 may be a splicing screen, where each part has its own signal lines and scan lines and driven by respective driving circuits.

Suppose that in an image frame, the first part of the display panel 1000 needs to show the same grayscale and the driving signal corresponding to a grayscale value GS1 is output to all signal lines coupled to the driving circuit DRV1. In the same image frame, partial of the second part of the display panel 1000 shows the same grayscale and other parts are scanned black; hence, the driving circuit DRV2 is configured to output the driving signal corresponding to the same grayscale value GS1 to several signal lines while not output driving signal to other signal lines.

As shown in FIG. 10, although the same grayscale image needs to be shown, the left-half part and the right-half part of the display panel 1000 may appear to have different brightness. In the left-half part controlled by the driving circuit DRV1, all LEDs are lit on with the driving signal pulses. The signal pulses in all signal lines generate a stronger capability to raise the voltage of the floating scan lines, and the rising voltage is coupled back to the signal lines to accelerate the rising speed of the signal pulses, thereby driving the LEDs to generate higher brightness. In contrast, in the right-half part controlled by the driving circuit DRV2, there are fewer LEDs lit on with the driving signal pulses; hence, the floating scan lines may rise with a lower level. Correspondingly, the coupling effect increases the rising speed of the signal pulses by a lesser level, thereby driving the LEDs in the right-half part to generate lower brightness than the LEDs in the left-half part.

The combination of the common-cathode and common-anode implementations in a display panel help solve the problem of brightness difference caused by coupling of parasitic capacitors. Please refer back to FIG. 5, where the display panel 500 includes coexisting common-cathode and common-anode structures of the LED pixels. In the common-cathode part where the cathode of the LEDs is commonly coupled to the scan line, the signal pulses may generate a rising coupling effect on the floating scan lines S[2]-S[N]. In the common-anode part where the anode of the LEDs is commonly coupled to the scan line, the signal pulses may generate a falling coupling effect on the floating scan lines S[2]-S[N]. Since each scan line receives both the rising coupling and the falling coupling, these two coupling effects may cancel out each other, thereby minimizing the voltage variations on the floating scan lines S[2]-S[N]. As a result, the influences on the transient behavior of the signal pulses caused by the capacitor coupling may also be minimized, so as to increase the uniformity of the displayed brightness and improve the picture quality.

Figure 11:
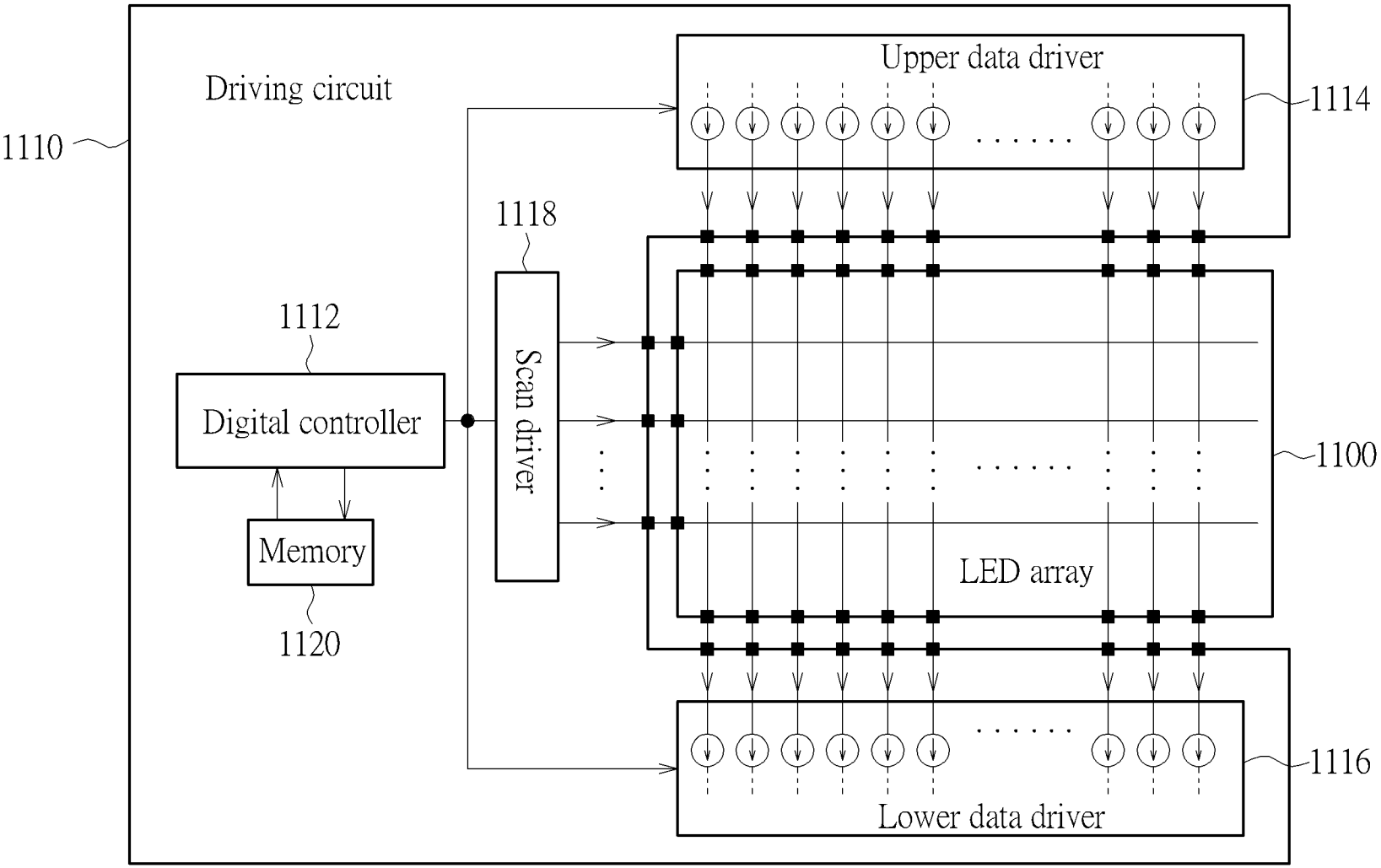
FIG. 11 is a schematic diagram of a display system according to an embodiment of the present invention.

Please refer to FIG. 11, which is a schematic diagram of a display system 110 according to an embodiment of the present invention. As shown in FIG. 11, the display system 110 includes a display panel 1100 and a driving circuit 1110. The display panel 1100 may be an LED panel composed of an LED array. The driving circuit 1110, which is configured to control and drive the display panel 1100, includes a digital controller 1112, an upper data driver 1114, a lower data driver 1116 and a scan driver 1118. A memory 1120, which may be included in the driving circuit 1110 or independent to the driving circuit 1110, is shown in FIG. 11 to facilitate the illustrations. The driving circuit 1110 may be realized as an integrated circuit (IC) included in one chip or a combination of multiple chips.

In detail, on the display panel 1100, each LED is coupled to one signal line and one scan line. The LEDs are coupled to the upper data driver 1114 and the lower data driver 1116 through the signal lines and coupled to the scan driver 1118 through the scan lines. As for those LEDs having the common-cathode structure, the anode is coupled to the upper data driver 1114 through the signal lines and the cathode is coupled to the scan driver 1118 through the scan lines. As for those LEDs having the common-anode structure, the cathode is coupled to the lower data driver 1116 through the signal lines and the anode is coupled to the scan driver 1118 through the scan lines.

The scan driver 1118 may scan the LEDs on the display panel 1100 line by line, and the upper data driver 1114 and the lower data driver 1116 may provide constant driving currents for the scanned LEDs. The scan driver 1118 maybe composed of multiple select switches for realizing the scan operations. The upper data driver 1114 may include multiple current sources for providing source currents for the display panel 1100. The lower data driver 1116 may include multiple current sources for providing sink currents for the display panel 1100. The detailed operations of the upper data driver 1114, the lower data driver 1116 and the scan driver 1118 are illustrated in the above paragraphs, and will be omitted herein.

The digital controller 1112 is configured to control the operations of the upper data driver 1114, the lower data driver 1116 and the scan driver 1118. In an embodiment, the digital controller 1112 may be a timing controller, for controlling and synchronizing the timing of the upper data driver 1114, the lower data driver 1116 and the scan driver 1118. The digital controller 1112 is further coupled to the memory 1120 such as a static random access memory (SRAM), where the display data maybe stored in the memory 1120 and then output to the upper data driver 1114 or the lower data driver 1116 on an appropriate time point based on the control of the digital controller 1112.

Figure 12A:
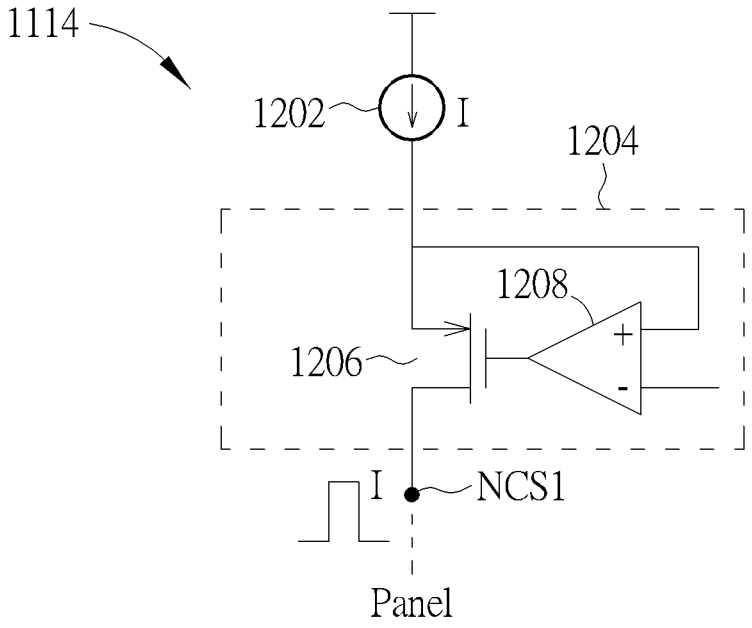
FIGS. 12A and 12B are schematic diagrams of an exemplary structure of the upper data driver and the lower data driver.
Figure 12B:
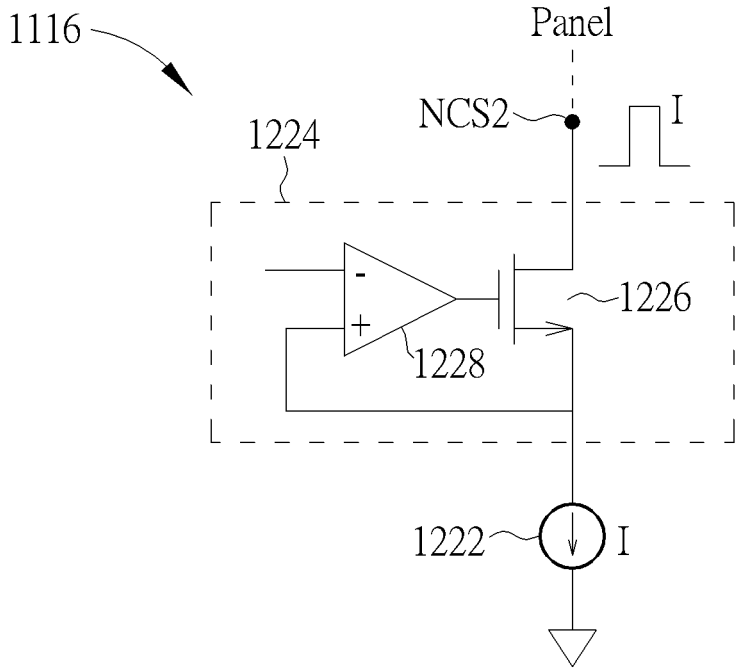

Please refer to FIGS. 12A and 12B, which are schematic diagrams of an exemplary structure of the upper data driver 1114 and the lower data driver 1116. FIG. 12A shows a detailed implementation of a channel of the upper data driver 1114, which includes a current source 1202 and a control switch 1204. In this embodiment, the upper data driver 1114 is configured to be coupled to the display panel through a current source terminal NCS1, and the control switch 1204 may be coupled between the current source 1202 and the current source terminal NCS1.

In detail, the control switch 1204 may include a transistor 1206 and an operational amplifier (op-amp) 1208. The transistor 1206 serves as the switch element, and the op-amp 1208 is coupled to the gate terminal and the source terminal of the transistor 1206 to construct a feedback loop. In order to control the current source 1202 to output a constant current, it is preferable to lock the output terminal of the current source 1202 to a constant voltage level. The op-amp 1208 with the feedback connection serves this purpose. Therefore, a current pulse with the constant current value I may be generated on the current source terminal NCS1 to be output to the panel based on the control of the control switch 1204.

Similarly, FIG. 12B shows a detailed implementation of a channel of the lower data driver 1116, which includes a current source 1222 and a control switch 1224. In this embodiment, the lower data driver 1116 is configured to be coupled to the display panel through a current sink terminal NCS2, and the control switch 1224 may be coupled between the current source 1222 and the current sink terminal NCS2. Similarly, the control switch 1224 may include a transistor 1226 and an op-amp 1228. The detailed operations of the control switch 1224 are similar to those of the control switch 1204 as described above, where a current pulse with the constant current value I may be generated on the current sink terminal NCS2 to be output from the panel based on the control of the control switch 1224.

Please note that FIGS. 12A and 12B merely show the structure of a channel in the upper data driver 1114 and the lower data driver 1116. In fact, there maybe a great number of channels with structures similar to those shown in FIGS. 12A and 12B in the upper data driver 1114 and the lower data driver 1116, to be coupled to multiple signal lines on the display panel.

It should also be noted that the present invention aims at providing a novel structure of the display panel and its driving circuit. Those skilled in the art may make modifications and alterations accordingly. For example, the LED panel structure of the present invention is hybrid with the common-cathode and common-anode implementations, where these two implementations may coexist in any appropriate manner. As long as the display panel includes a first LED of which the anode is connected to a signal line and the cathode is connected to a scan line, and a second LED of which the anode is connected to the same scan line and the cathode is connected to another signal line, the related implementations should belong to the scope of the present invention. Correspondingly, the driving circuit of the present invention has a source data driver and a sink data driver, where the source data driver includes one or more current sources used to output current(s) to the LED panel, and the sink data driver includes one or more current sources used to receive current(s) from the LED panel.

The embodiments of the present invention are applicable to any type of panel in which light emission is performed by lighting on the LEDs, especially to a PM-LED panel. Examples of the panel may include, but not limited to, a mini-LED panel and a micro-LED panel.

To sum up, the present invention provides a novel structure of the LED panel, where the LED (s) having the common-cathode structure and the LED (s) having the common-anode structure coexist in the panel. The common-cathode structure is that the anode of the LED is coupled to the signal line and the cathode of the LED is coupled to the scan line, and the common-anode structure is that the anode of the LED is coupled to the scan line and the cathode of the LED is coupled to the signal line. The driving circuit for driving the LED panel may include an upper data driver, a lower data driver, and a scan driver. The upper data driver (or called source data driver) includes current sources configured to output currents to the LED panel, and the lower data driver (or called sink data driver) includes current sources configured to receive currents from the LED panel. The scan driver includes select switches used for scan the LEDs line by line.

According to the present invention, a scan line maybe coupled to the cathode of common-cathode LEDs and the anode of common-anode LEDs on the panel; hence, the source currents from the common-cathode LEDs and the sink currents to the common-anode LEDs may cancel out each other, thereby minimizing the crossing voltage of the select switch included in the scan driver. The decreasing of the crossing voltage of the select switch may decrease the requirement of the magnitude of the power supply voltage, so as to reduce the power consumption of the display system. In another aspect, the coupling of parasitic capacitors of the LEDs is unavoidable in the LED panel. In the panel structure where the common-cathode LEDs and the common-anode LEDs coexist, the rising coupling effect generated by the common-cathode LEDs and the falling coupling effect generated by the common-anode LEDs may cancel out each other, thereby minimizing the voltage variations on the floating scan lines caused by the capacitor coupling. As a result, the influences on the transient behavior of the signal pulses may also be minimized, so as to increase the uniformity of the displayed brightness and improve the picture quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit for a light-emitting diode (LED) panel, the LED panel having a plurality of LEDs, which comprising a first LED and a second LED, an anode of the first LED being coupled to a first signal line, a cathode of the first LED being coupled to a scan line, an anode of the second LED being coupled to the scan line, and a cathode of the second LED being coupled to a second signal line, wherein the first signal line is not physically connected to a cathode of any of the plurality of LEDs, and the second signal line is not physically connected to an anode of any of the plurality of LEDs, the driving circuit comprising:

a first current source, coupled to the first signal line of the LED panel, configured to output a first current to the LED panel through the first signal line; and a second current source, coupled to the second signal line of the LED panel, configured to receive a second current from the LED panel through the second signal line.

2. The driving circuit of claim 1, wherein the first current source is configured to be coupled to the anode of the first LED on the LED panel, and the second current source is configured to be coupled to the cathode of the second LED on the LED panel.

3. The driving circuit of claim 1, wherein the first current source is configured to output the first current to the anode of the first LED, and the second current source is configured to receive the second current from the cathode of the second LED.

4. The driving circuit of claim 1, further comprising:

a first control switch, coupled between the first current source and the first signal line; and a second control switch, coupled between the second current source and the second signal line.

5. The driving circuit of claim 1, further comprising:

a select switch, configured to be coupled to the cathode of the first LED on the LED panel and the anode of the second LED on the LED panel.

6. A light-emitting diode (LED) panel, having a plurality of LEDs, the plurality of LEDs comprising:

a first LED, comprising:

an anode, coupled to a first signal line; and a cathode, coupled to a scan line; and a second LED, comprising:

an anode, coupled to the scan line; and a cathode, coupled to a second signal line;

wherein the first signal line is not physically connected to a cathode of any of the plurality of LEDs, and the second signal line is not physically connected to an anode of any of the plurality of LEDs.

7. The LED panel of claim 6, wherein the first LED is configured to receive a source current from a driving circuit through the first signal line, and the second LED is configured to output a sink current to the driving circuit through the second signal line.

8. The LED panel of claim 7, wherein the first LED and the second LED are configured to receive a scan signal from the driving circuit through the scan line.

9. The LED panel of claim 6, wherein the first LED is a red LED of a pixel, the second LED is a green LED of the pixel, and the pixel further comprises:

a blue LED, comprising:

an anode, coupled to the scan line; and a cathode, coupled to a third signal line.

10. The LED panel of claim 6, wherein the first LED is a green LED of a pixel, the second LED is a red LED of the pixel, and the pixel further comprises:

a blue LED, comprising:

an anode, coupled to a third signal line; and a cathode, coupled to the scan line.

* * * * *